United States Patent [19]

Rasmussen

[11] Patent Number: 4,752,102

[45] Date of Patent: Jun. 21, 1988

[54] ELEVATING AND SUPPORTING APPARATUS

[76] Inventor: Keith O. Rasmussen, 980 Broadway, San Francisco, Calif. 94124

[21] Appl. No.: 852,383

[22] Filed: Apr. 14, 1986

Related U.S. Application Data

[63] Continuation of Ser. No. 368,956, Apr. 16, 1982, abandoned.

[51] Int. Cl.[4] ..... A47C 3/40; E04G 1/22

[52] U.S. Cl. ..... 297/345; 108/147; 182/141; 187/9 E; 187/95; 248/188.5; 248/405

[58] Field of Search ..... 297/345, 347, 348; 248/188.2, 188.5, 157, 161, 405, 656, 669; 187/9 E, 95; 108/144, 147; 312/312; 182/141, 148

[56] References Cited

U.S. PATENT DOCUMENTS

| | | | |
|---|---|---|---|
| 1,319,943 | 10/1919 | Bessolo | 182/141 X |
| 1,905,626 | 4/1933 | Hershey | 182/148 X |
| 1,998,517 | 4/1935 | Moore | 312/343 |
| 2,020,503 | 11/1935 | Hanson et al. | 248/188.5 |
| 2,180,161 | 11/1939 | Miller | 312/312 |
| 2,418,244 | 4/1947 | Baird | 312/343 |
| 2,605,151 | 7/1952 | Shampaine | 108/7 |
| 2,763,339 | 9/1956 | North | 182/148 X |
| 3,028,210 | 4/1962 | Byars | 312/312 X |
| 3,190,711 | 6/1965 | Haas | 312/312 X |
| 3,229,790 | 1/1966 | Shayne | 108/144 X |
| 3,361,510 | 1/1968 | McDermott | 248/404 X |
| 3,828,694 | 8/1974 | Nestler et al. | 248/157 X |
| 3,964,725 | 6/1976 | Matsui et al. | 297/348 X |
| 3,999,733 | 12/1976 | Harder, Jr. et al. | 297/345 X |
| 4,065,194 | 12/1977 | Mattia | 108/147 X |
| 4,348,051 | 9/1982 | Boucher | 248/405 X |

FOREIGN PATENT DOCUMENTS

| | | | |
|---|---|---|---|
| 159744 | 11/1954 | Australia | 108/144 |
| 291091 | 7/1913 | Fed. Rep. of Germany | 297/347 |
| 55335 | 11/1910 | France | 312/343 |
| 346988 | 7/1960 | Switzerland | 312/343 |

*Primary Examiner*—Kenneth J. Dorner
*Assistant Examiner*—Peter R. Brown
*Attorney, Agent, or Firm*—Mallinckrodt & Mallinckrodt

[57] ABSTRACT

Apparatus having telescoping box-like cage sections and capable of raising a person or object to a desired height and solidly supporting same at such height, the relative movement of the sections being guided by pre-loaded rollers bearing against vertical guide surfaces provided by the flanges of angle iron members forming the vertical edges of the cage sections. A method is disclosed for assembling the apparatus with the rollers pre-loaded against the cooperating guide surfaces by clamping the angle iron members of the outer cage inwardly before connecting them with cross members under tension.

35 Claims, 5 Drawing Sheets

FIG. 1
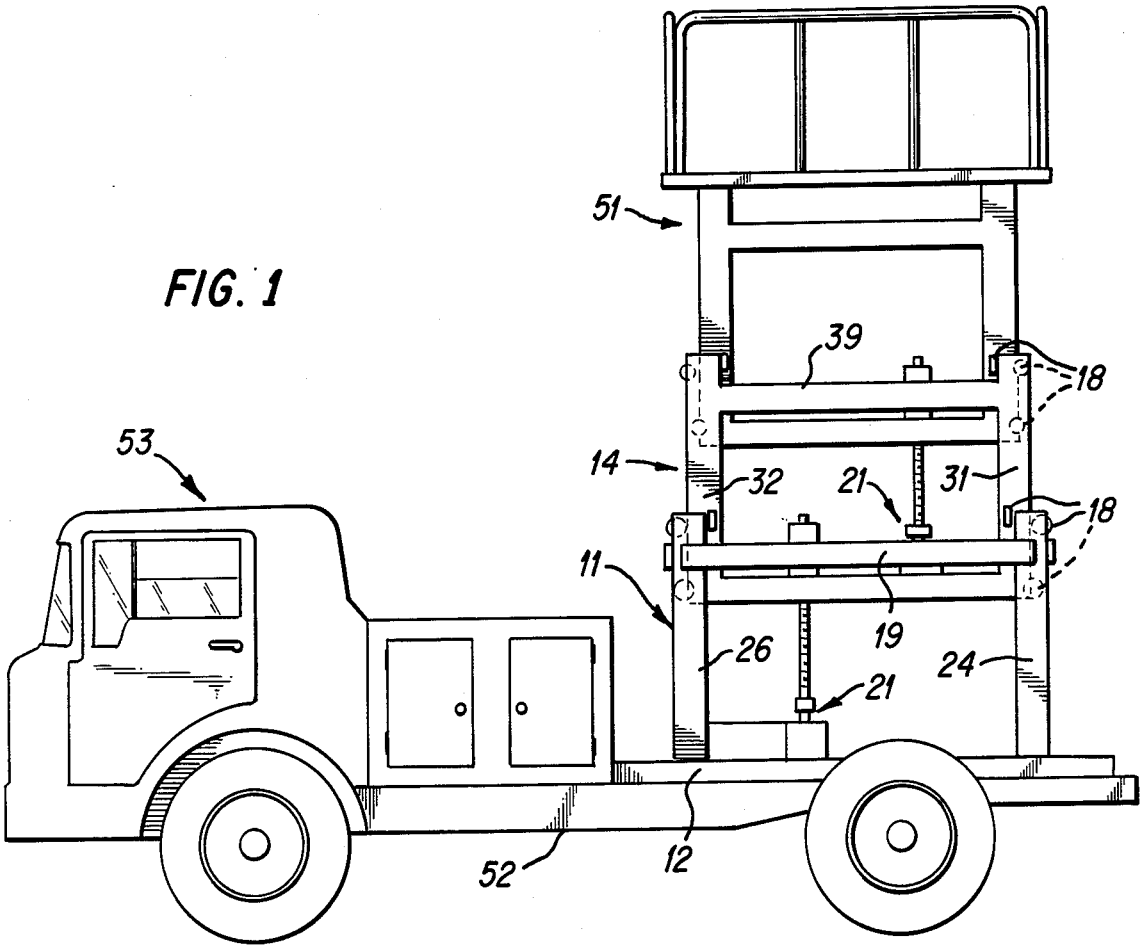
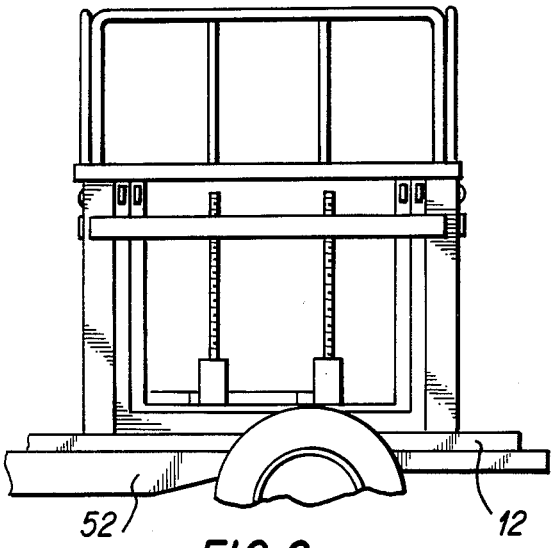
FIG. 2
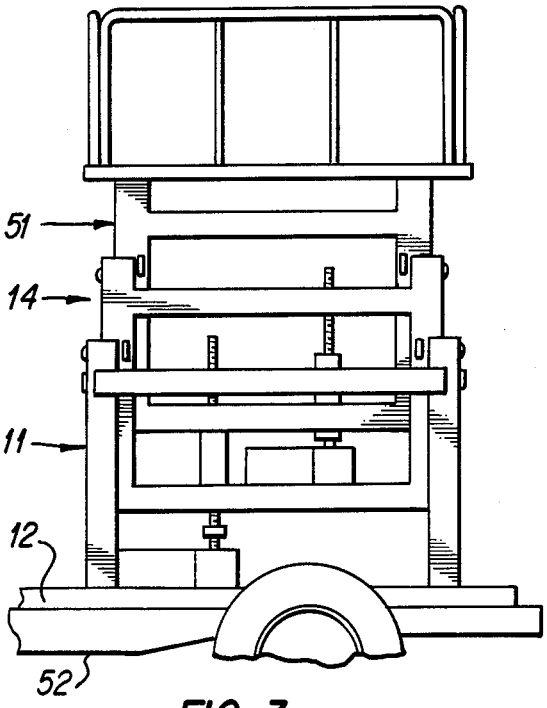
FIG. 3

ELEVATING AND SUPPORTING APPARATUS

This is a continuation of co-pending application Ser. No. 06/368,956 filed on Apr. 16, 1982, now abandoned.

BACKGROUND OF THE INVENTION

1. Field of the Invention

This invention relates to elevating and supporting apparatus capable of raising or lowering an object or person to a desired height and thereafter rigidly supporting same at that height. The invention also relates to methods for assembling such apparatus.

2. Description of the Prior Art

It is often necessary to support an object or person at an adjustable height and, in many instances, it is necessary that the object or person be supported firmly and solidly without any wobble or play in the supporting mechanism. One example of such requirement may be found in the construction of dental chairs wherein a mechanism in the base is formed for moving the seat structure upwardly or downwardly to the desired height. Any looseness or play in the supporting mechanism causes the chair to wobble, resulting in the patient feeling uneasy and uncomfortable.

Manufacturers of dental chairs have spent large amounts of money in developing and manufacturing mechanisms capable of lifting, lowering and supporting the patient with the required degree of solidity. Among the more popular of these methods are the mounting of the seat structure on a hydraulic ram, or upon a massive scissors jack, or upon a member mounted in sliding guideways and moved vertically as by a rack and gear assembly. In each of these alternatives, the main problem is solidiy of support, and this problem is usually solved by expensive precision machining to close tolerances of the various surfaces which are in sliding contact with each other.

Similar problems are encountered in other fields, such as elevatable work platforms for electricians working on overhead wires and lights, where precision in lifting and lowering, and solid support at all heights, is essential.

SUMMARY OF THE INVENTION

The present invention successfully avoids problems of expensive precision machining by eliminating sliding guide surfaces entirely. To accomplish this, pre-loaded rollers contact guide surfaces which do not have to be machined. Indeed, in one form of the invention, the guide surfaces are provided by the inner and outer faces of the flanges of angle irons.

Pre-loading of the rollers, by pressing them firmly against the surfaces upon which they roll, eliminates any necessity for machined guide surfaces sliding upon each other and also accomodates some lack of parallelism between the guide surfaces. Also, the present structure accomodates a wide variety of powered lifting devices which do not have to be precisely aligned with the direction of travel.

The method of the present invention is directed to a mode of assembly capable of providing the desired pre-loading of the rollers by keeping them pressed firmly into contact with their cooperating guide surfaces. In accomplishing this, in a preferred form of the invention, the inner of a pair of telescoping cages is assembled and rollers are journaled at the lower ends of the angle irons which define the vertical edges of the box-like cage. The lower ends of the angle irons destined to form the vertical edges of the outer cage are secured in the desired relationship, and rollers are journaled at the upper ends of such guideways.

The angle irons of the outer cage are moved inwardly to press or clamp their rollers firmly against the outer faces of the angle irons of the inner cage and, at the same time, to press or clamp the rollers on the inner cage firmly against the inner faces of the angle irons on the outer cage. With the angle irons of the outer cage clamped as described, the rollers are all pressed firmly against the guide surfaces over which they travel and any play is eliminated, but the rollers can still revolve and ride over a slightly uneven or misaligned guide surface.

The angle irons are then secured in the described tightly pressed relationship by welding on, or otherwise attaching, cross members which will remain under tension to maintain the described pressing of the rollers against their guide surfaces.

The described method eliminates looseness and play between the telescoping cages and hence provides the desired solidity of support.

It is therefore an object of the present invention to provide elevating and supporting apparatus capable of lifting or lowering an object or person being supported to any desired position between the uppermost and lowermost positions of which the apparatus is capable, and also capable of supporting the person or object firmly and solidly at the desired height.

Another object of the present invention is to provide a method for assembling the described apparatus in a simple and effective manner providing a desired preloading action.

A further object of the present invention is to provide an apparatus of the character described in which sliding contact between guide surfaces is eliminated, hence eliminating expensive precision machining.

A still further object of the present invention is to provide an apparatus of the character described which is simple, sturdy and easy to assemble, and which is forgiving of slight misalignments of the parts.

Another object of the present invention is to provide an apparatus of the character set forth in which the drive mechanism for lifting and lowering the object or person being supported works freely without requiring precise alignment.

Yet another object of the present invention is to provide an elevating and supporting apparatus which is compact vertically, but which can extend vertically over a considerable distance merely by multiplying telescoping sections.

Other objects and features of advantage will become apparent as the specification progresses and from the claims.

BRIEF DESCRIPTION OF THE DRAWINGS

FIG. 1 is a side elevational view of an apparatus constructed in accordance with the present invention and having a plurality of telescoping cage sections, the apparatus being illustrated in vertically extended position.

FIG. 2 is a view taken similarly to that of FIG. 1, but showing the apparatus in vertically retracted position.

FIG. 3 is a view taken similarly to that of FIG. 1, but showing the apparatus in an intermediate position.

Figure 4:
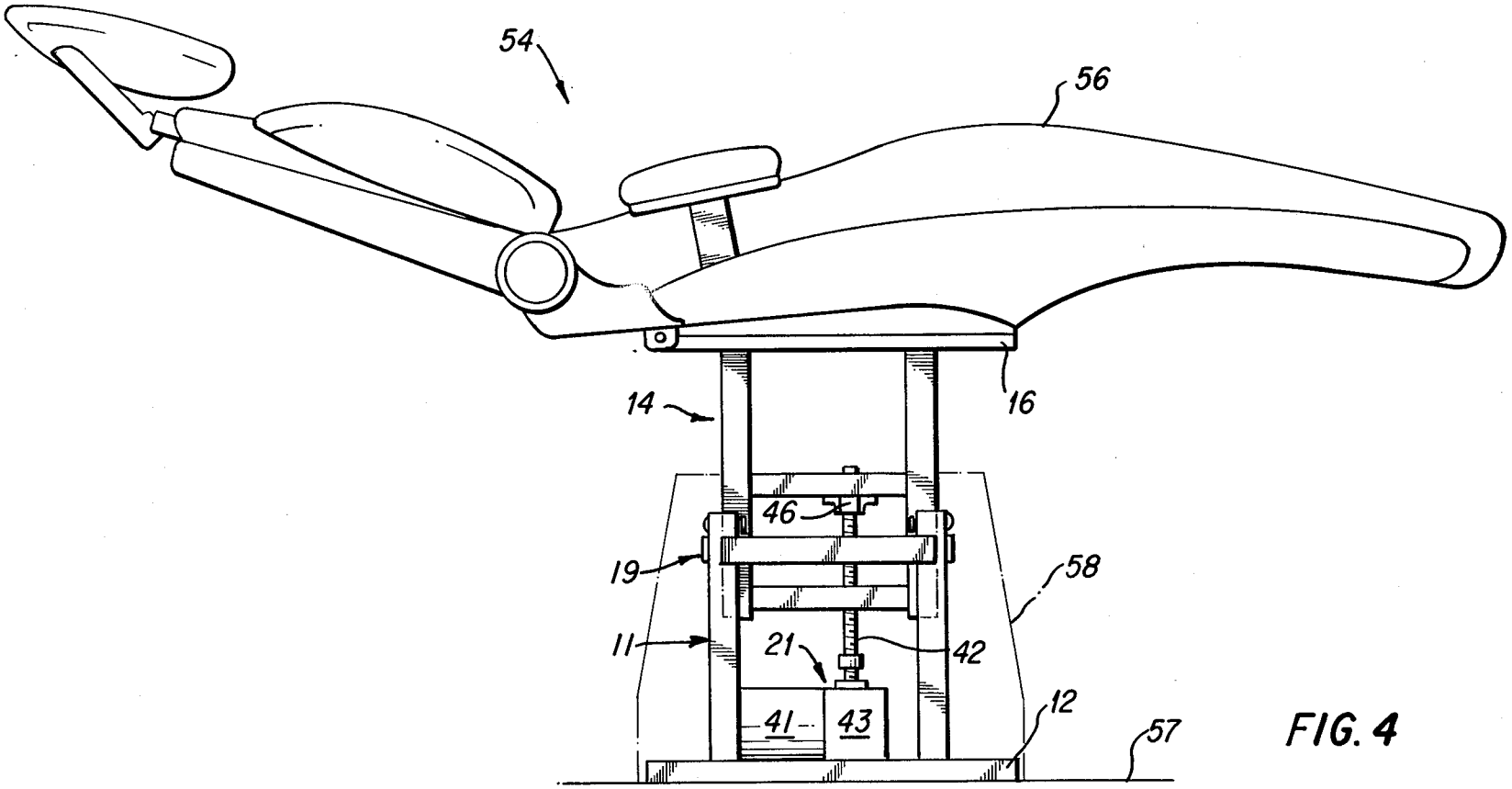
FIG. 4 is a side elevational view of a base structure for vertically adjustable chairs constructed in accordance with the present invention and shown in operative association with a lounge-type dental chair.

While only certain preferred forms of the invention are illustrated in the drawings, it will be apparent that various modification could be made without departing from the ambit of the claims.

DESCRIPTION OF THE PREFERRED EMBODIMENTS

Figure 5:
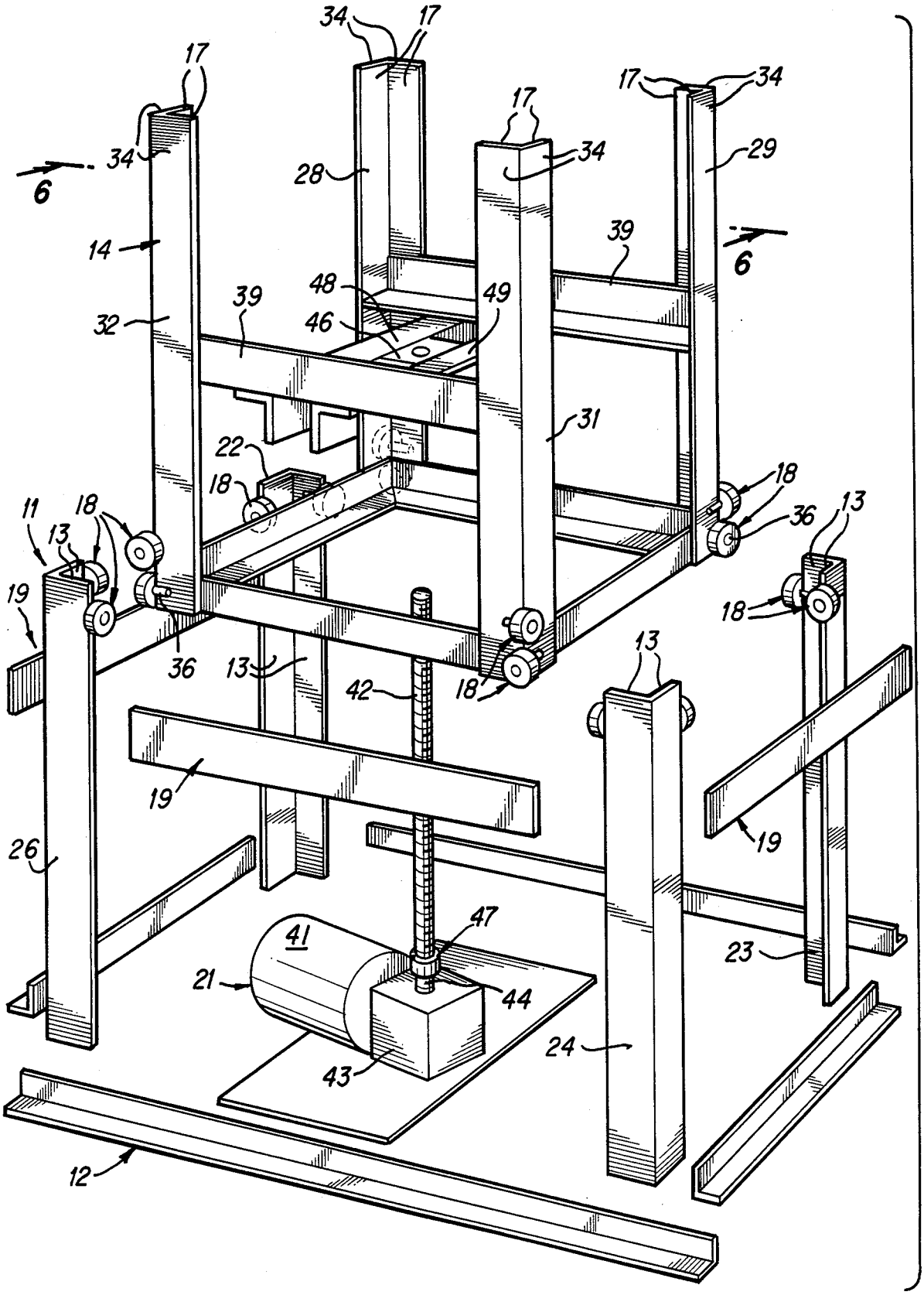
FIG. 5 is an exploded perspective view of the base structure of FIG. 4, with portions removed for clarity of illustration.
Figure 7:
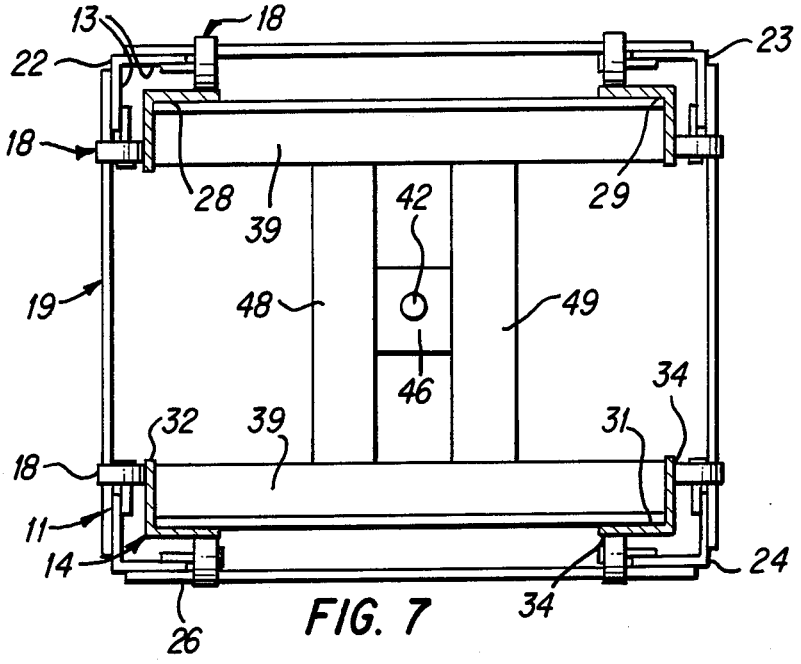
FIG. 7 is a plan-sectional view taken substantially on the plane of line 7—7 of FIG. 6.
Figure 6:
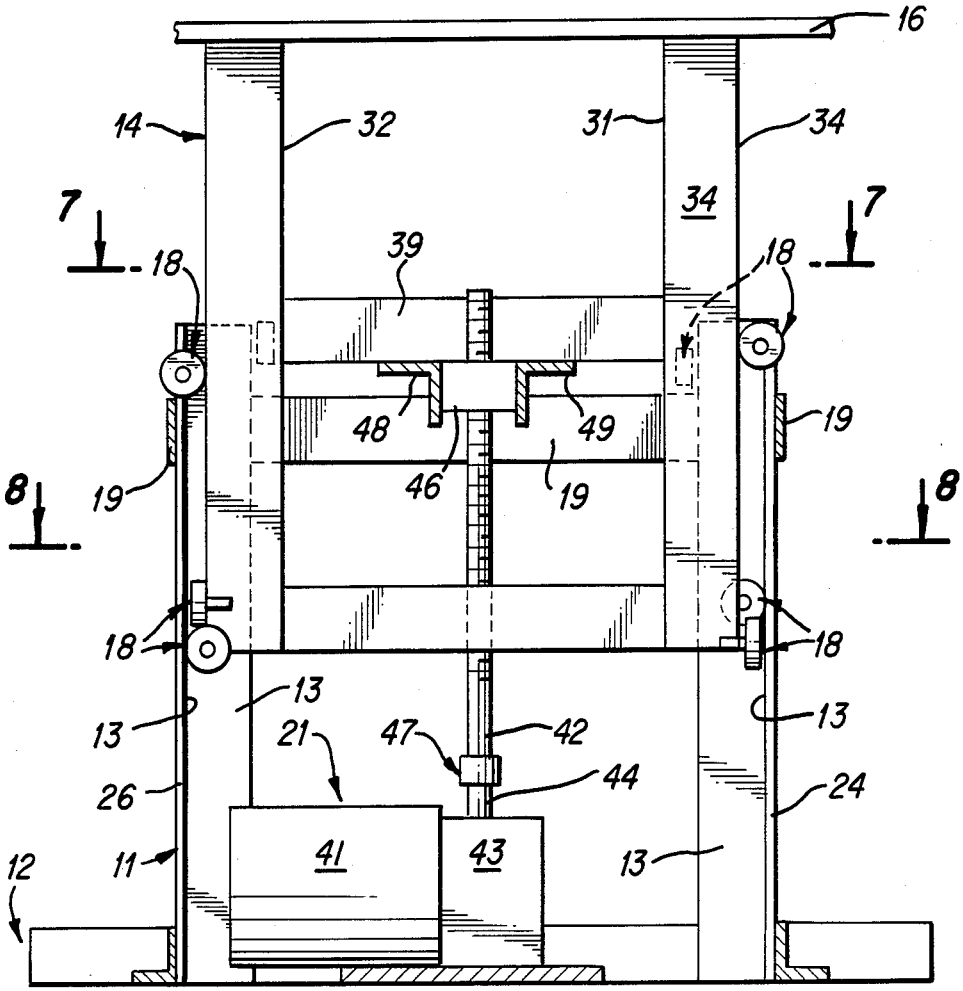
FIG. 6 is a vertical cross-sectional view on an enlarged scale taken substantially on the plane of line 6—6 of FIG. 4.
Figure 8:
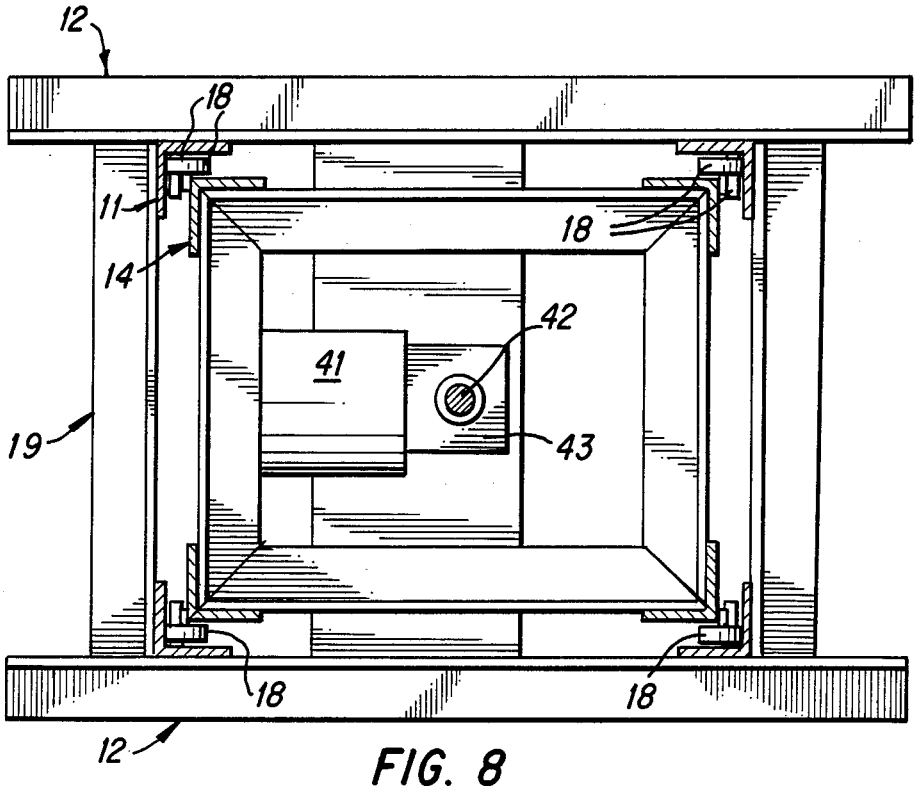
FIG. 8 is a plan sectional view taken substantially on the plane of line 8—8 of FIG. 6.

As may be seen in the accompanying drawings, the elevating and supporting apparatus of the present invention has a first cage 11 providing guide means mounted on a base element 12 and formed to provide a plurality of vertically extending spaced parallel guide surfaces 13, FIG. 5, a second cage 14 providing guide means adapted for supporting an object 16, FIG. 6, and formed to provide a plurality of vertically extending second guide surfaces 17 in parallel spaced relation to each other and to the first guide surfaces 13, roller means 18 journaled on the guide means of cage 11 and on the guide means of cage 14, respectively. Such roller means are formed for rolling contact with the confronting guide surfaces on the other opposing guide means. Tensioning means 19 are provided for holding each of the roller means 18 in tightly pressed engagement with the guide surfaces they contact, as well as elevating means 21 for displacing cage 14 vertically with respect to cage 11. In accordance with the present invention, the guide means of cage 11 are formed to provide angularly related generally flat guide surfaces 13, and the guide means of cage 14 are formed to provide sets of angularly related generally flat guide surfaces 17 and 34, respectively.

Preferably, and as here shown, the guide means of cage 11 is provided by four upstanding guide members 22, 23, 24 and 26 having their lower ends mounted on the base element 12. The guide members 22, 23, 24 and 26 are conveniently in the form of lengths of angle iron, with the inner faces of the angle iron flanges providing the described guide surfaces 13.

The guide means of cage 14 likewise is provided by four downwardly extending guide members 28, 29, 31 and 32 mounted at their upper ends on a support member 16, these guide members also conveniently being in the form of lengths of angle iron, with the inner faces of the angle iron flanges providing the described guide surfaces 17 and the outer faces providing the guide surfaces 34.

Roller means 18 is mounted at the lower end of each of the guide members 28, 29, 31 and 32 in position for rolling contact with the inner faces 13 of the flanges of the angle iron guide members 22, 23, 24 and 26. Similarly, roller means 18 is mounted at the upper end of each of the angle iron guide members 22, 23, 24 and 26 in position for rolling contact with the outer faces 34 of the guide members 28, 29, 31, and 32.

As here shown, the vertical guide members 22, 23, 24 and 26 are joined together by laterally extending members 19 to define the open topped cage 11 into which is inserted the similar but smaller cage 14 defined by the guide members 28, 29, 31 and 32 joined together by lateral members 39. The cages 11 and 14 are formed and proportioned so that they can be telescoped together, with the smaller cage 14 nested within the larger cage 11.

For reasons of economy, stability and ease of construction, the cages 11 and 14 are here illustrated as being of rectangular box-like construction with the guide members 22, 23, 24 and 26 defining the vertical edges of the box-like cage 11 and with the guide members 28, 29, 31 and 32 defining the vertical edges of the inner box-like cage 14. It should be appreciated, however, that the cages may be of other, regular or irregular, polygonal configurations, so long as at least three of the vertical edges are provided by similar guide members. While a minimum of three guide members would appear to be necessary for the desired stability, utilizing four vertical guide members in a rectangular box-like configuration is more efficient in utilizing the physical properties of angle iron when the latter is used to provide the guide members.

As a novel feature of the present invention, the elevating means 21 needs only be capable of raising or lowering the load to the desired height and preventing further descent. While hand operated elevating means 21, such as a manually operable hydraulic pump or lever jack, may be used, it is usually preferable where power is available to make the elevating means power driven.

The elevating means 21 illustrated in the drawings utilizes an electric motor 41 to drive a vertically extending screw 42 through a conventional gear reducer 43 having an output shaft 44 to which the screw 42 is secured for joint rotation. A follower 46 having an opening therethrough threadibly engaged with shaft 42 is pivotally secured to a pair of angle iron cross members 48 and 49 attached to the lateral members 39. Because no part of the elevating means 21 is used to support the load against lateral movement, the screw 42 does not have to be aligned precisely with the direction of movement so long as the mounting of motor 41 and gear reducer 43 on the base element 12 permits relative movement therebetween, or the connection 47 between the gear reducer output shaft 44 and the screw 42 permits deflection of screw 42 from axial alignment with shaft 44.

As an important feature of the present invention, the apparatus may be elevated to a height several times the height of the apparatus when in its retracted position. This is accomplished by simply adding further telescoping sections or cages in the manner illustrated in FIGS. 1 through 3 of the drawings. As there shown, one or more additional cages 51 are provided, in this instance there being one additional cage 51 formed to telescope within cage 14, which in turn telescopes within cage 11.

In most instances, for stability, the lowermost cage will be the larger one. However, it should be appreciated that the order could be reversed, with the smallest cage being the one resting upon the base element 12 and the largest cage being the one which can be elevated to the greatest height of which the apparatus is capable.

In FIGS. 1 through 3 of the drawings, the apparatus is shown mounted on a wheeled vehicle, such as on the bed 52 of a truck 53. In this mode, the apparatus is particularly useful in providing a stable work platform capable of being elevated and held at any desired height throughout the operating range of the equipment. Stable, height adjustable platforms are particularly useful in elevating electricians to the correct height for working on overhead wiring, such as trolley wiring, with the platform being steadily and solidly supported.

The apparatus of the present invention also is particularly suited for use as a base structure supporting a vertically adjustable dental or operating chair 54, FIG. 4. In recent years, reclining lounge chairs have come into widespread use by dentists, and to a lesser extent by surgeons who operate in the head area. Because the patient is lying in a supine position, he or she is particularly sensitive to any wobbling or other indication of insecure support. Also, the operations performed by the dentist or surgeon can be adversely affected if unwanted and unexpected movement occurs. The present apparatus provides the necessary firm and solid support characteristics.

A typical installation of the apparatus of the present invention as a base support for a lounge-type dental chair is illustrated in FIG. 4 of the drawings. As there shown, the seat structure 56 of the dental chair 54 is carried upon the support member 16, and the base element 12 is in the form of a base member adapted to rest upon a floor 57, or like supporting surface. In actual use, the present apparatus would be enclosed within and covered by a sheet metal housing, the position of which is indicated by the phantom lines 58. However, the housing 58 has been removed in the drawings to reveal the internal structure.

As an important feature of the present invention, a method is provided for assembling the telescoping cages in such manner as to provide the desired pre-loading of the rollers by keeping them clamped tightly into rolling contact with their cooperating guide surfaces. As may best be seen in FIGS. 5 and 9 of the drawings, the inner cage 14 (which in the case of dental chairs supports the seat structure 56) is first assembled with the angle irons 28, 29, 31 and 32 substantially parallel. The angle irons 22, 23, 24 and 26 of the base cage 11 are supported with the guide surfaces 13 in contact with the rollers carried on the cage 38, and with the guide surfaces 17 in contact with the rollers carried on the base cage 11. This automatically aligns the parts and ensures that the rollers will be able to ride along their respective guide surfaces without binding even though preloaded.

Figure 9:
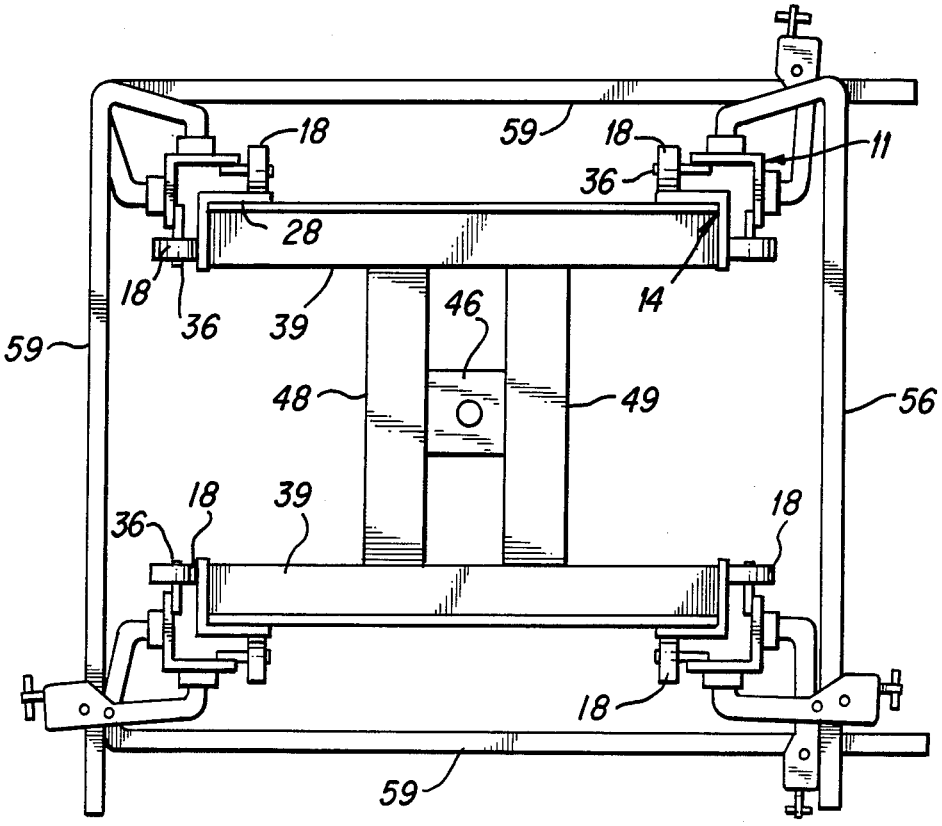
FIG. 9 is a view taken similarly to that of FIG. 7, but illustrating the method of assembly.

To accomplish the described pre-loading of the rollers against their respective guide surfaces, the angle irons 22, 23, 24 and 26 are urged firmly inwardly, as by clamps 59, FIG. 9, until the desired amount of pre-loading pressure is accomplished. The tensioning means 19 is here provided by metal bars which are then positioned and welded at their opposite ends to adjacent ones of the angle irons 22, 23, 24 and 26. The bars 19 are thus kept under tension and the rollers are constantly pressed firmly against their guide surfaces.

From the foregoing, it will be seen that the method and apparatus of the present invention provides a novel and valuable elevating and supporting apparatus capable of lifting and object or person to a desired height and thereafter supporting the object or person in a firm and solid manner, the apparatus being capable of attaining elevations several times the minimum height of the apparatus merely by adding further telescoping sections.

What I claim as new and desire to secure by Letters Patent is:

1. A base structure for vertically adjustable dental chairs or the like, comprising a base member adapted for resting on a surface such as a floor, first guide means on said base member formed to provide first and second sets of vertically extending spaced parallel planar first guide surfaces with the planes of said first set substantially perpendicular to the planes of said second set, second guide means adapted for supporting a dental chair seat structure and formed to provide first and second sets of vertically extending spaced parallel second guide surfaces with the planes of said first set of said second guide surfaces substantially perpendicular to the planes of said second set of said second guide surfaces, said first and second sets of said guide surfaces on said first guide means being in parallel spaced mutually confronting relationship to said first and second sets respectively of said guide surfaces on said second guide means, a cylindrical upper roller journaled to each of said guide surfaces on said first guide means adjacent to the upper end thereof and with the periphery of each of said rollers in rolling engagement with the guide surface confronting the guide surface to which such upper roller is journaled, a cylindrical lower roller journaled to each of said guide surfaces on said second guide means adjacent to the lower end thereof and with the periphery of each of said rollers in rolling engagement with the guide surface confronting the guide surface to which such lower roller is journaled, tensioning means connected under tension between said guide means for holding each of said rollers in tightly pressed engagement with the guide surface it contacts, and elevating means connected between said base member and said dental chair seat structure and formed for relative displacement of said first and second guide means vertically and with each of said rollers rolling along the guide surface it contacts during said relative displacement.

2. A base structure for vertically adjustable dental chairs or the like as described in claim 1, and wherein said first guide means comprises four upstanding first guide members rectangularly mounted on said base member.

3. A base structure for vertically adjustable dental chairs or the like as described in claim 2, and wherein said upstanding guide members are each in the form of a length of structural steel angle iron having an L-shaped cross section providing perpendicularly related flanges, with the flanges of each angle iron providing said first and second sets of guide surfaces.

4. A base structure for vertically adjustable dental chairs or the like as described in claim 3, and wherein said angle irons are mounted with the included right angle between said flanges defining the interior edges of a box-shaped cage, and said first guide surfaces are on the inner faces of said flanges.

5. A base structure for vertically adjustable dental chairs or the like as described in claim 2, and wherein said second guide means comprises four downwardly extending second guide members rectangularly mounted to a support member in parallel spaced relation to said upstanding first guide members.

6. A base structure for vertically adjustable dental chairs or the like as described in claim 3, and wherein said downwardly extending second guide members are each in the form of a length of structural steel angle iron having an L-shaped cross section providing perpendicularly related flanges, with the flanges of each such angle iron providing said first and second sets of guide surfaces.

7. A base structure for vertically adjustable dental chairs and the like as described in claim 6, and wherein said angle irons are mounted with the obtuse angle between said flanges defining the exterior edges of a box-shaped cage, and said second guide surfaces are on the outer edges of said flanges.

8. A base structure for vertically adjustable dental chairs or the like as described in claim 1, and wherein said first and second guide means each comprises four vertically oriented guide members rectangularly mounted on a base member and a supporting member respectively to define cages, one of said cages having smaller lateral dimensions than the other, said cages being telescoped together with the smaller cage nested within the larger cage and with the guide members of each cage in parallel spaced relation to the corresponding guide members of the other cage.

9. A base structure for vertically adjustable dental chairs or the like as described in claim 8, and wherein said guide members are in the forms of lengths of L-shaped cross section structural steel angle iron defining the vertical edges of cages, and with the flanges of said lengths of angle iron providing the said first and second sets of guide surfaces.

10. A base structure for vertically adjustable dental chairs or the like as described in claim 9, and wherein said first sets of guide surfaces are on the inner faces of the flanges of the angle irons defining the vertical edges of the larger of said cages, and said second sets of guide surfaces are on the outer faces of the flanges of the angle irons defining the vertical edges of the smaller of said cages.

11. A base structure for vertically adjustable dental chairs or the like as described in claim 9, and wherein said tensioning means comprises lateral members secured between adjacent pairs of said lengths of angle iron of said first guide means with said first guide surfaces pressed tightly against the said roller means they engage.

12. A base structure for vertically adjustable dental chairs or the like as described in claim 1, and wherein said elevating means is operatively connected to said guide means and to said base member, with said elevating means being formed for effecting upward and downward movement of said second guide means relative to said base member.

13. A base structure for vertically adjustable dental chairs or the like as described in claim 12, and wherein said elevating means is power driven by a motor.

14. A base structure for vertically adjustable dental chairs or the like as described in claim 13, and wherein said elevating means comprises a reversible electric motor connected to one of said guide means, a gear reducer connected to and driven by said electric motor, an elongated drive screw extending substantially vertically from said gear reducer, and a follower threadably engaging said driven screw and pivotally connected to the other of said guide means.

15. Elevating and supporting apparatus, comprising a horizontally extending base member, four vertically upstanding elongated guide members positioned at the corners of a horizontal rectangle on said base member and extending upwardly therefrom to form a first rectangular cage, each of said upstanding guide members providing first and second planar guide surfaces perpendicular to each other and extending substantially the length of said upstanding guide members, a second rectangular cage mounted for vertical movement above said base member and having four elongated guide members vertically positioned to form the vertical edges of said second cage, each of said guide members of the second cage providing first and second planar guide surfaces perpendicular to each other and extending substantially the length of said depending guide members, said first and second planar guide surfaces on said upstanding guide members being positioned in parallel spaced relation to said first and second planar guide surfaces on the guide members of the second cage, first rollers journaled on each of said upstanding guide members in rolling engagement with said first and second planar guide surfaces on each of said guide members of the second cage, second rollers journaled on each of said guide members of the second cage in rolling engagement with said first and second planar guide surfaces on each of said upstanding guide members, tensioning means connected under tension between said upstanding guide members for holding each of said rollers in tightly pressed engagement with the guide surfaces they contact, and elevating means connected between said base member and said second cage and formed for selective relative displacement of said second cage vertically with respect to said base member and said first cage, with said rollers rolling along the guide surfaces they contact during said relative displacement.

16. Elevating and supporting apparatus as described in claim 15, and wherein said upstanding guide members and said guide members of the second cage are each in the form of a length of angle iron of structural steel having an L-shaped cross section providing perpendicularly related flanges, with the flanges of each angle iron providing said first and second planar guide surfaces.

17. Elevating and supporting apparatus as described in claim 16, and wherein said angle irons are mounted with the included right angle between said flanges defining the edges of a box-shaped cage interior, and said first and second planar guide surfaces for the rollers of the second cage are provided by the inner faces of said flanges.

18. Elevating and supporting apparatus as described in claim 17, wherein said planar guide surfaces for the rollers of the first cage are provided by the outer faces of the flanges of said guide members forming the vertical edges of said second cage.

19. Elevating and supporting apparatus as described in claim 17, and wherein said tensioning means comprises lateral members secured between adjacent pairs of said guide members with first and second planar guide surfaces on said upstanding guide members pressed tightly against the rollers of the second cage, and with first and second planar guide surfaces on said guide members of the second cage pressed tightly against the rollers of the first cage.

20. Elevating and supporting apparatus as described in claim 16, and wherein said elevating means comprises a reversible electric motor, a gear reducer driven by said electric motor, an elongated drive screw extending vertically from and driven by said gear reducer, and a follower threadably engaging said drive screw and pivotally connected to said cage.

21. Elevating and supporting apparatus as described in claim 15, and wherein said elevating means is operatively connected to said rectangular second cage and said base member, with said elevating means being formed for effecting upward and downward movement to desired height of said second cage relative to said second base member and for firmly holding said cage at the desired height.

22. Elevating and supporting apparatus, comprising a base element, first guide means mounted on said base element and formed to provide first and second sets of vertically extending spaced parallel planar first guide surfaces with the planes of said first set substantially perpendicular to the planes of the second set, second guide means adapted for supporting an object and formed to provide first and second sets of vertically extending spaced parallel second planar guide surfaces with the planes of said first set of said second guide surfaces substantially perpendicular to the planes of said second set of said second guide surfaces, said first and second sets of said guide surfaces on said first guide means being in parallel spaced mutually confronting relationship to said first and second sets respectively of said guide surfaces on said second guide means, a cylindrical upper roller journaled to each of said guide surfaces on said first guide means adjacent to the upper end thereof and with the periphery of each of said rollers in rolling engagement with the guide surface confronting the guide surface to which such upper roller is journaled, a cylindrical lower roller journaled to each of said guide surfaces on said second guide means adjacent to the lower end thereof and with the periphery of each of said rollers in rolling engagement with the guide surface confronting the guide surface to which such lower roller is journaled, tensioning means connected under tension between said guide means for holding each of said rollers in tightly pressed engagement with the guide surface it contacts, and elevating means connected between said base element and said second guide means and formed for relative displacement of said first and second guide means vertically and with each of said rollers rolling along the guide surface it contacts during said relative displacement.

23. Elevating and supporting apparatus as described in claim 22, and wherein said first guide means comprises four upstanding first guide members rectangularly mounted to said base element.

24. Elevating and supporting apparatus as described in claim 23 and wherein said upstanding guide members are each in the form of a length of structural steel angle iron having an L-shaped cross section affording perpendicularly related flanges, with the flanges of each such angle iron providing said first and second sets of guide surfaces.

25. Elevating and supporting apparatus as described in claim 24, and wherein said angle irons are mounted with the included right angle between said flanges defining the interior vertical edges of a box-shaped cage, and said first guide surfaces are on the inner faces of said flanges.

26. Elevating and supporting apparatus as described in claim 25, and wherein said second guide surfaces are on the outer faces of said flanges.

27. Elevating and supporting apparatus as described in claim 22, and wherein said second guide means comprises four downwardly extending second guide members rectangularly mounted to a support member.

28. Elevating and supporting apparatus as described in claim 27, and wherein said downwardly extending guide members are each in the form of a length of structural steel angle iron having an L-shaped cross section affording perpendicularly related flanges, with the flanges of each such angle iron providing said first and second sets of guide surfaces.

29. Elevating and supporting apparatus as described in claim 22, and wherein said first and second guide means each comprises four vertically oriented guide members rectangularly mounted to a base member and a supporting member respectively to define cages, one of said cages having smaller lateral dimensions than the other whereby said cages are able to telescope together with the smaller cage nested within the larger cage.

30. Elevating and supporting apparatus as described in claim 29, and wherein said guide members are in the form of lengths of L-shaped cross section structural steel angle iron defining the vertical edges of said cages, and with the flanges of said lengths of angle iron providing the said first and second sets of guide surfaces.

31. Elevating and supporting apparatus as described in claim 30, and wherein said first sets of guide surfaces are on the inner faces of the flanges of the angle irons defining the vertical edges of the larger of said cages, and said second sets of guide surfaces are on the outer faces of the flanges of the angle irons defining the vertical edges of the smaller of said cages.

32. Elevating and supporting apparatus as described in claim 30, and wherein said tensioning means comprises lateral members secured between adjacent pairs of said lengths of angle iron of said first guide means with said first guide surfaces pressed tightly against the peripheries of the rollers they engage.

33. Elevating and supporting apparatus as described in claim 22, and wherein said elevating means is operatively connected to said second guide means and to said base element, with said elevating means being formed for expanding and contracting so as to effect upward and downward movement of said second guide means relative to said base element.

34. Elevating and supporting apparatus as described in claim 33, and wherein said elevating means is power driven by a motor.

35. Elevating and supporting means as described in claim 34, and wherein said elevating means comprises a reversible electric motor connected to one of said guide means, a gear reduced connected to and driven by said electric motor, an elongated drive screw extending vertically from and driven by said gear reducer, and a follower threadably engaging said drive screw and pivotally connected to the other of said guide means.

* * * * *